United States Patent [19]

Clark

[11] Patent Number: 4,517,901

[45] Date of Patent: May 21, 1985

[54] TRANSACTION DRAWER ASSEMBLY

[76] Inventor: Larry G. Clark, 5532 Hollister Dr., Indianapolis, Ind. 46224

[21] Appl. No.: 504,535

[22] Filed: Jun. 15, 1983

[51] Int. Cl.[3] ..... E05G 7/00

[52] U.S. Cl. ..... 109/19; 109/66; 109/73; 232/43.3; 232/43.1

[58] Field of Search ..... 109/10, 11, 19, 66, 109/70, 64, 73; 232/43.1, 43.3, 44

[56] References Cited

U.S. PATENT DOCUMENTS

| | | | |
|---|---|---|---|
| 3,145,918 | 8/1964 | Higgins et al. | 109/19 |
| 3,237,853 | 3/1966 | Grosswiller, Jr. | 232/43.3 |
| 3,390,833 | 7/1968 | Harris | 109/19 |
| 3,682,113 | 8/1972 | McClellan et al. | 109/19 |
| 4,069,773 | 1/1978 | Clark | 109/19 |
| 4,190,004 | 2/1980 | Richardson | 109/19 |
| 4,351,247 | 9/1982 | Clark | 109/19 |

FOREIGN PATENT DOCUMENTS

| | | | |
|---|---|---|---|
| 1808371 | 5/1970 | Fed. Rep. of Germany | 109/19 |

*Primary Examiner*—Gary L. Smith
*Assistant Examiner*—Neill Wilson
*Attorney, Agent, or Firm*—Woodard, Weikart, Emhardt & Naughton

[57] ABSTRACT

A cash-and-carry transaction drawer assembly comprises a housing mounted to a cabinet on a cashier's side of a building wall. A front door is provided in the housing. A drawer is glidably mounted in the housing behind the door and has a lid at its top. When the drawer is "closed", the lid accommodates access of the cashier to the contents of the drawer, and the front door is closed. Cam means on the drawer operate to raise the lid to an access-excluding position as the drawer is opened, and open the door for access to the drawer by a customer outside the wall. The cam means for the lid and door have different rates of actuation so that the lid is closed more quickly than the door is opened. The mounting of the door minimizes projection thereof outside the wall when opened, to maximize the access of the customer to the contents of the drawer, when opened.

17 Claims, 6 Drawing Figures

TRANSACTION DRAWER ASSEMBLY

BACKGROUND OF THE INVENTION

1. Field of the Invention

This invention relates generally to drawers such as used by cashiers for through-the-wall transactions with customers, and more particularly to a drawer assembly having improved isolation between the spaces outside and inside the wall during operation of the drawer.

2. Description of the Prior Art

There are a few patents of which I am aware from prior work and which show sliding drawers or trays. An example is a German Offenlegungsschrift No. 1 808 371 dated May 21, 1970 cited in my U.S. Pat. No. 4,069,773 and which discloses a trough below the security screen between a customer and cashier and where a sliding tray is mounted and operated from the cashier's side. A pivoted plate over the tray is so arranged that when closed there is a flat surface; pivoted one way it opens the trough to the client; pivoted the other it seals the opening to the client. The pivoting action is determined by the position of the sliding tray.

Another through-the-wall device is shown in my U.S. Pat. No. 4,351,247 issued Sept. 28, 1982. That unit involves a vertical hinge about which a sector shaped shelf is swingable. In that example, the housing projects through the wall. For some situations, it is desirable that there be no projections external to the wall surface. A transaction drawer having curved front edges to operate a door is shown on page 7 of a catalog of Creative Industries, Inc. of 959 North Holmes Avenue, Indianapolis, Ind. 46222. It does not have a cover over the drawer on the cashier's side of the wall.

There are publications by various manufacturers other than Creative Industries but, except for one, and I am uncertain of its date, none of them of which I am aware disclose products more pertinent to the present invention than are the most pertinent of the aforementioned references. In the one, there is a drawer with a sliding cover over the drawer. The cover slides into position over the drawer cavity as the drawer is opened. I believe the rate of siding of the cover is greater than the rate of linear movement of the drawer. In my opinion, there remains a need for a drawer which provides better isolation between the space inside and outside the building wall where the transaction is occuring. The present invention is directed to meeting that need.

SUMMARY OF THE INVENTION

Described briefly, according to a typical embodiment of the present invention, a transaction drawer assembly comprises a housing mountable to cabinetry or the like on a cashier's side of a building wall and having a front frame for reception at the exterior of the wall. A front door is provided in the housing. A drawer is glidably mounted in the housing behind the door and has a lid at its top.

When the drawer is "closed", the lid is in a position accommodating access of the cashier to the contents of the drawer, and the front door is closed. The drawer has cam means thereon, one of which is operable to raise the lid to an access excluding position as the drawer is opened, and the other of which opens the front door for access to the drawer by a customer outside the wall. The cam means for the lid and door have different rates of actuation so that the lid is closed more quickly than the door is opened. Also, the mounting of the door is such as to minimize the amount of projection thereof outside the wall when opened, in order to maximize the access of the customer to the contents of the drawer, when opened.

DESCRIPTION OF THE PREFERRED EMBODIMENT

Figure 1:
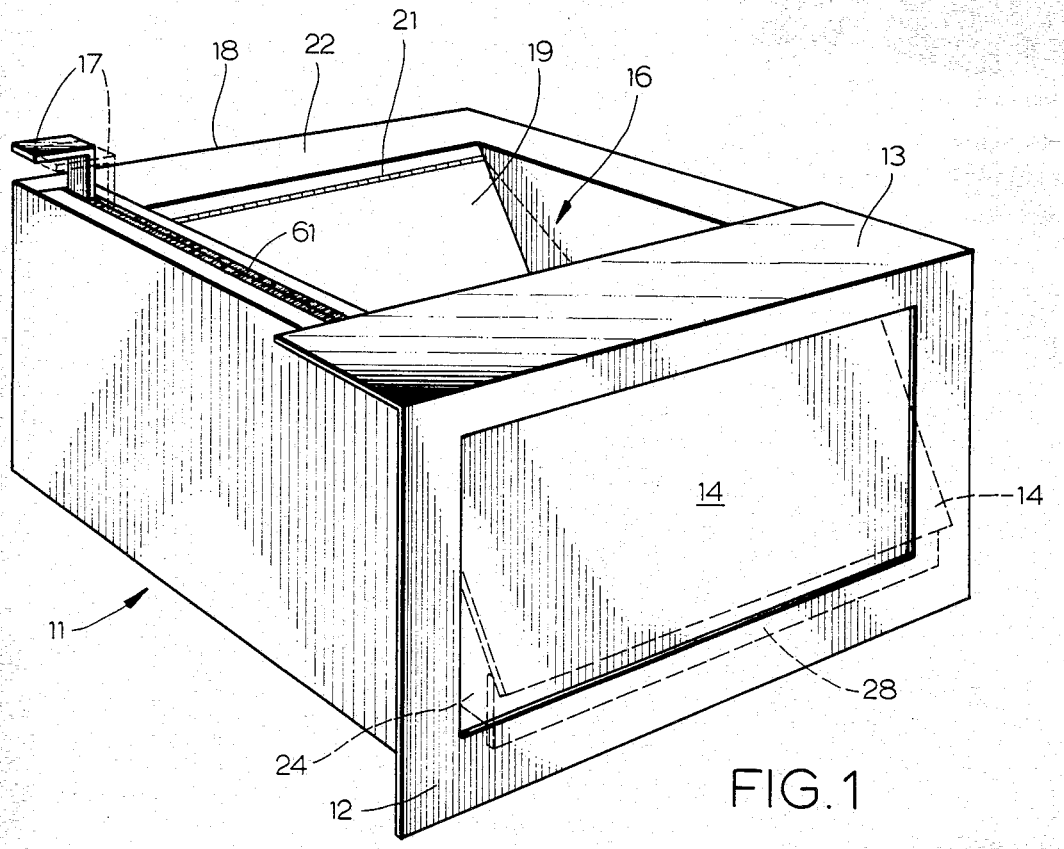
FIG. 1 is a perspective view of the drawer assembly with the drawer closed and showing, in dotted lines, the drawer assembly as it is just beginning to be opened.

Referring now to the drawings in detail, FIG. 1 shows the assembly with the drawer closed. The features most easily noted are the housing 11 having a front frame flange 12 with integral rearwardly-extending hood 13 affixed to the housing. A front door 14 is pivotally mounted in the housing. A drawer 16 is inside the housing. An operating handle 17 connected to the drawer projects up from the housing near the rear-end 18 thereof. A lid 19 is hinged at 21 to the top 22 of the housing near the rear.

Figure 2:
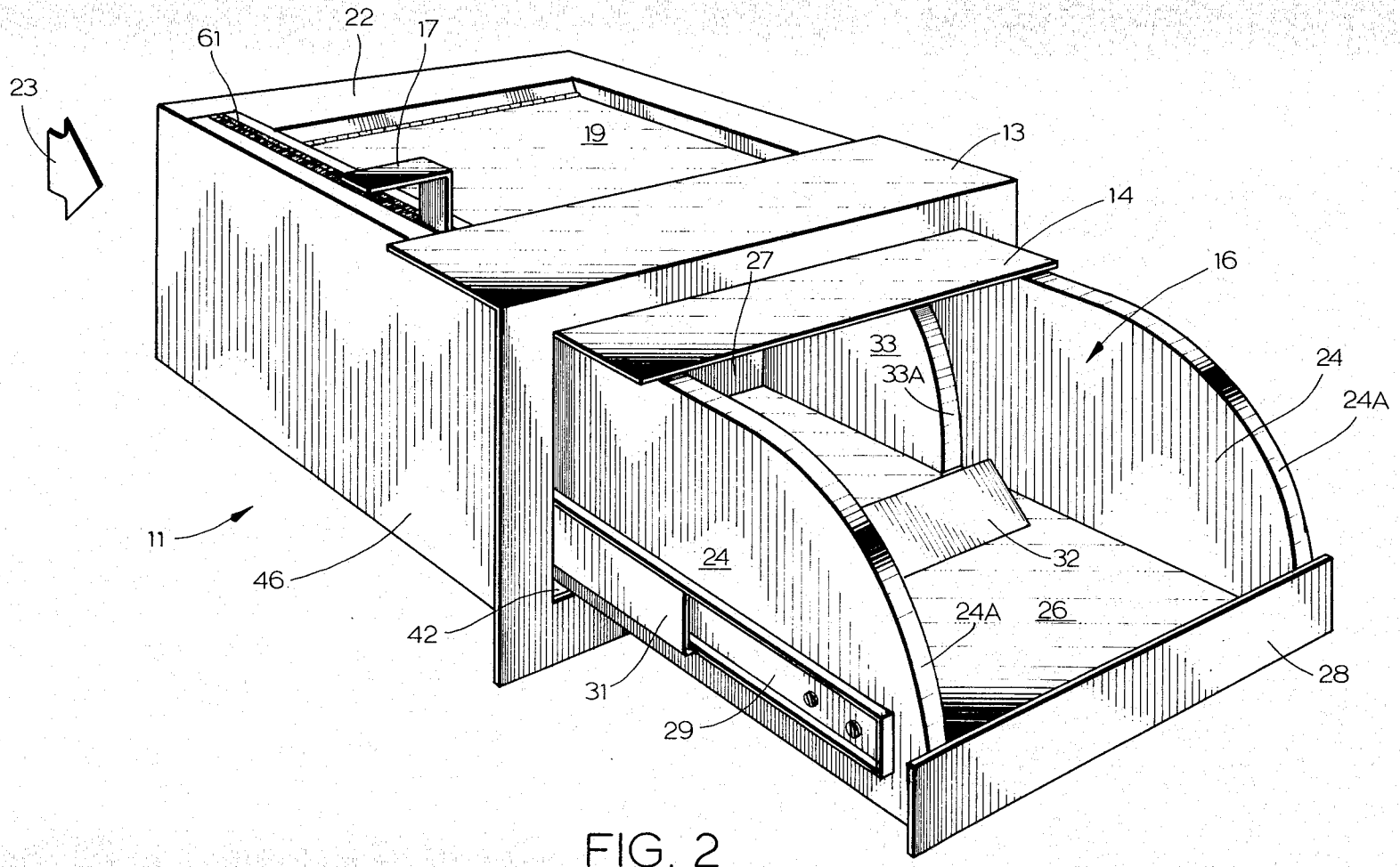
FIG. 2 is a perspective view of the drawer assembly with the drawer fully opened.

Referring now to FIG. 2, the open the drawer, the handle 17 has been moved forward in the direction of arrow 23 from the FIG. 1 position to a full forward position whereupon the door 14 is fully opened, and the drawer 16 is fully opened. The lid 19 is fully closed. In this view, some additional features of the assembly can be seen. These include the drawer outside walls 24, the floor 26, the rear wall 27 and the front wall 28. Front and intermediate portions 29 and 31 of a ball-bearing drawer extension slide assembly can be seen on the left side of the drawer. A center stop member 32 is shown secured to the floor of the drawer. One of the lid cams 33 can be seen secured to the right-hand wall 24 of the drawer. The curved cam surface 33A thereon can be seen, as can the curved cam surfaces 24A at the front of the drawer sidewalls.

Figure 3:
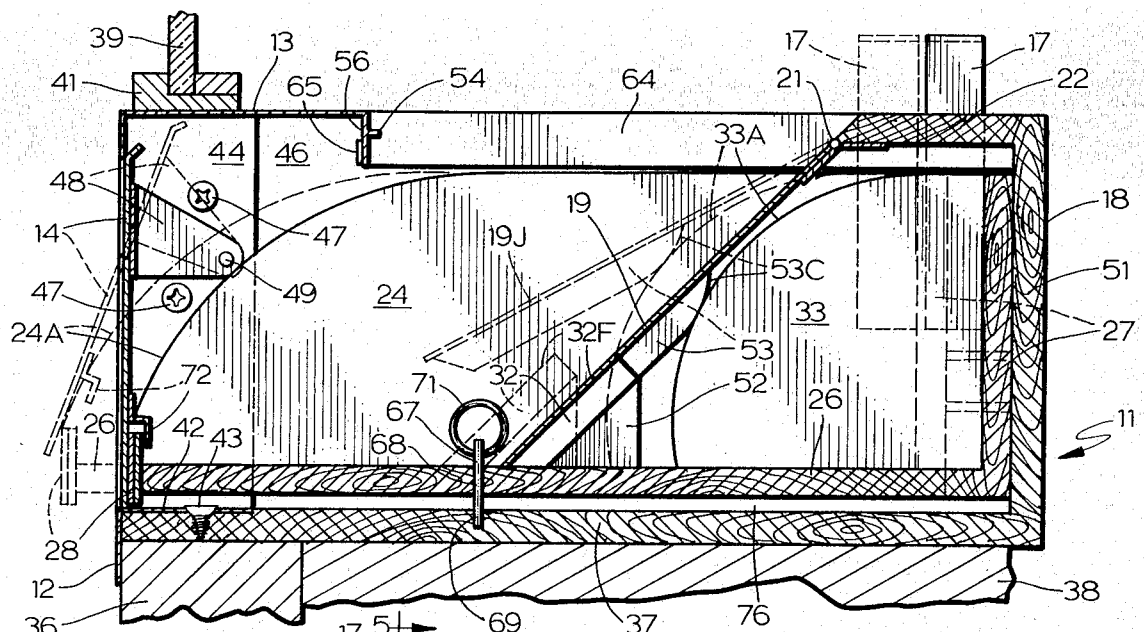
FIG. 3 is a longitudinal section through the drawer assembly with the wall shown fragmentarily and the drawer closed and showing in dotted lines, the position of the drawer, lid and door partially opened as in the dotted lines of FIG. 1.

Referring now to FIG. 3, some additional features can be seen. In this view, the building wall 36 is shown immediately below the bottom 37 of the housing 11. It is possible to mount the housing on the wall 36, if desired. A more likely approach would be to support the housing on a counter such as shown fragmentarily at 38 immediately inside the building wall, attach it to the counter 38 such as by screws or nails, and have the front portion of the housing project into an opening in the building wall.

A window 39 is mounted in the upper portion of the wall opening above the housing. The lower cross member 41 of the window frame is shown and can be secured in the wall, and to the top 13 of the housing hood. The bottom portion of the flange of the front frame can be seen at 12 extending over a portion of the front face of the wall 36. A horizontal flange 42 extends rearwardly from the upper margin of the lower portion of flange 12 and is secured to the bottom 37 of the housing by screws such as 43. Similarly, the front frame has upstanding rearwardly-extending side flanges such as 44 which are fastened to the housing sidewall such as 46 (FIG. 2) by screws 47. The front door 14 has rearwardly extending brackets 48 at each side which are pivotally mounted at 49 to the housing sidewalls. The rear wall of the housing is shown at 51. The housing walls are typically made of plywood base with a Formica brand or other brand of decorative hard shell or veneer.

Figure 4:
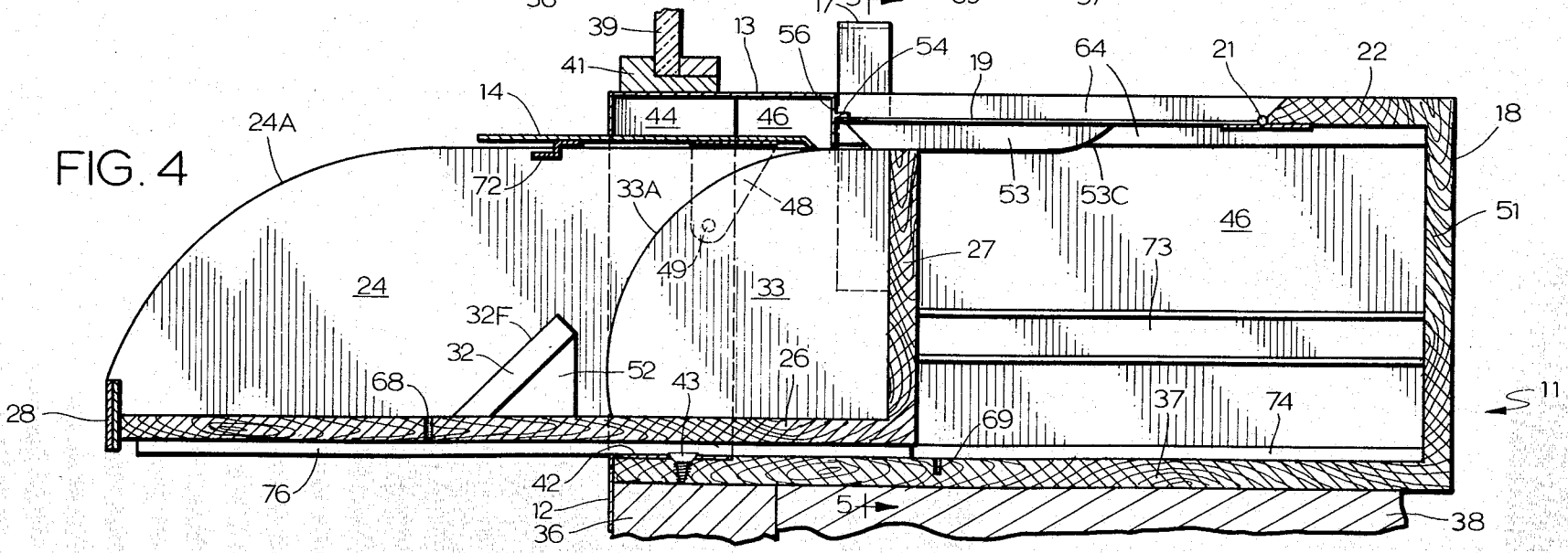
FIG. 4 is a side elevational view with the drawer fully opened as in FIG. 2.

The center stop 32 is mounted to the floor of the drawer and is braced by a pair of horizontally spaced gussets 52, also affixed to the drawer floor 26. The lid 19 is a stainless steel plate and may rest on the upper front face 32F of the center stop when the drawer is shut as shown in FIG. 3. The plate has a pair of cam follower rails 53 secured to its lower face and outboard of the center stop. The curved rear edges 53C of the cam follower rails engage the front curved cam faces 33A of the cover cams 33 affixed to the inside faces of the drawer sidewalls 24. These cam surfaces cooperate as the drawer is opened, to push the lid up through the position shown by the dotted line 19J in FIG. 3, to a stop position against the rearwardly extending stop flange 54 mounted on the downturned flange 56 which is at the rear of the hood 13 and of material integral with it. This position of the lid is shown in FIG. 4. At the same time, the front door is pushed open by the cam surfaces 24A of the drawer side walls until the door is fully opened to the position shown in FIG. 4. It is one feature of the present invention that the lid is fully closed before the door is fully open. In the illustrated embodiment, this is achieved by providing that cam surfaces 33A and 24A have different arcs whereby the lid is closed before the door is fully opened.

Figure 6:
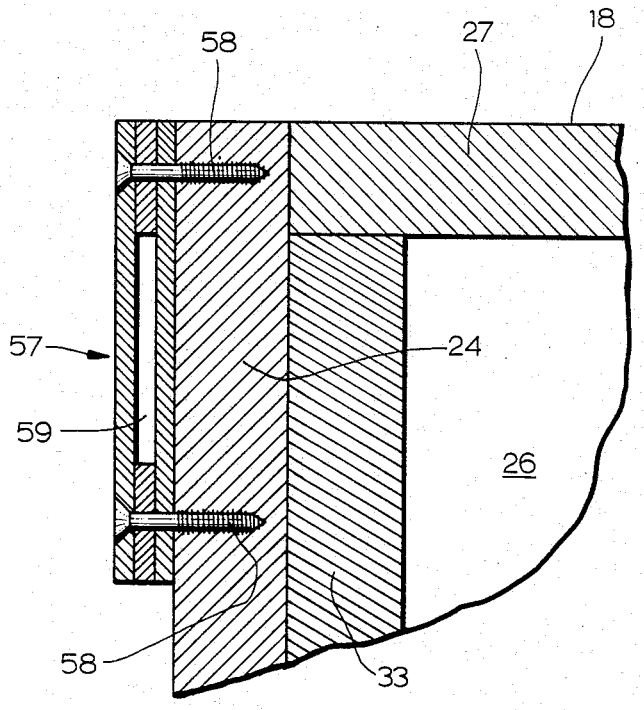
FIG. 6 is an enlarged fragmentary sectional view of the operating handle and slot in the drawer, the view being taken at line 6—6 in FIG. 5 and viewed in the direction of the arrows.

The drawer operating handle 17 was previously mentioned. It is received in a slot assembly 57 affixed to the side of the drawer by screws 58 as shown in FIG. 6. The handle is thereby received in the slot 59. To operate the drawer, it moves along another slot 61 shown in FIGS. 1 and 2 at the top of the housing, and best shown in FIG. 5. This slot is formed by an aluminum extrusion 62 affixed to the top edge of the housing sidewall 46. A similar extrusion 63, is provided at the other side of the slot 61. It is bolted to the aluminum angle section member 64 which is fastened at its rear-end to the housing top rear wall 22 and, at its front end, to an angle brace 65 fastened to the downturned flange 56 at the rear of the hood 13. A brush-type of weather strip seal 66 is mounted in each of these extrusions to seal the handle as it moves back and forth in slot 61.

The drawer is lockable in its closed position by a drop-bolt lock-pin 67 received through apertures 68 and 69 in the drawer floor 26 and housing floor 37, respectively, when the drawer is closed. A finger loop 71 is provided for easy withdrawal of the pin when the drawer is to be unlocked.

Although the lower edge of the front door 14 extends down to the lower edge of the front wall 28 of the drawer when the drawer is closed, an overlapping flange 72 is also provided and is affixed to the door and extends down behind the upper edge of the drawer front 28.

Figure 5:
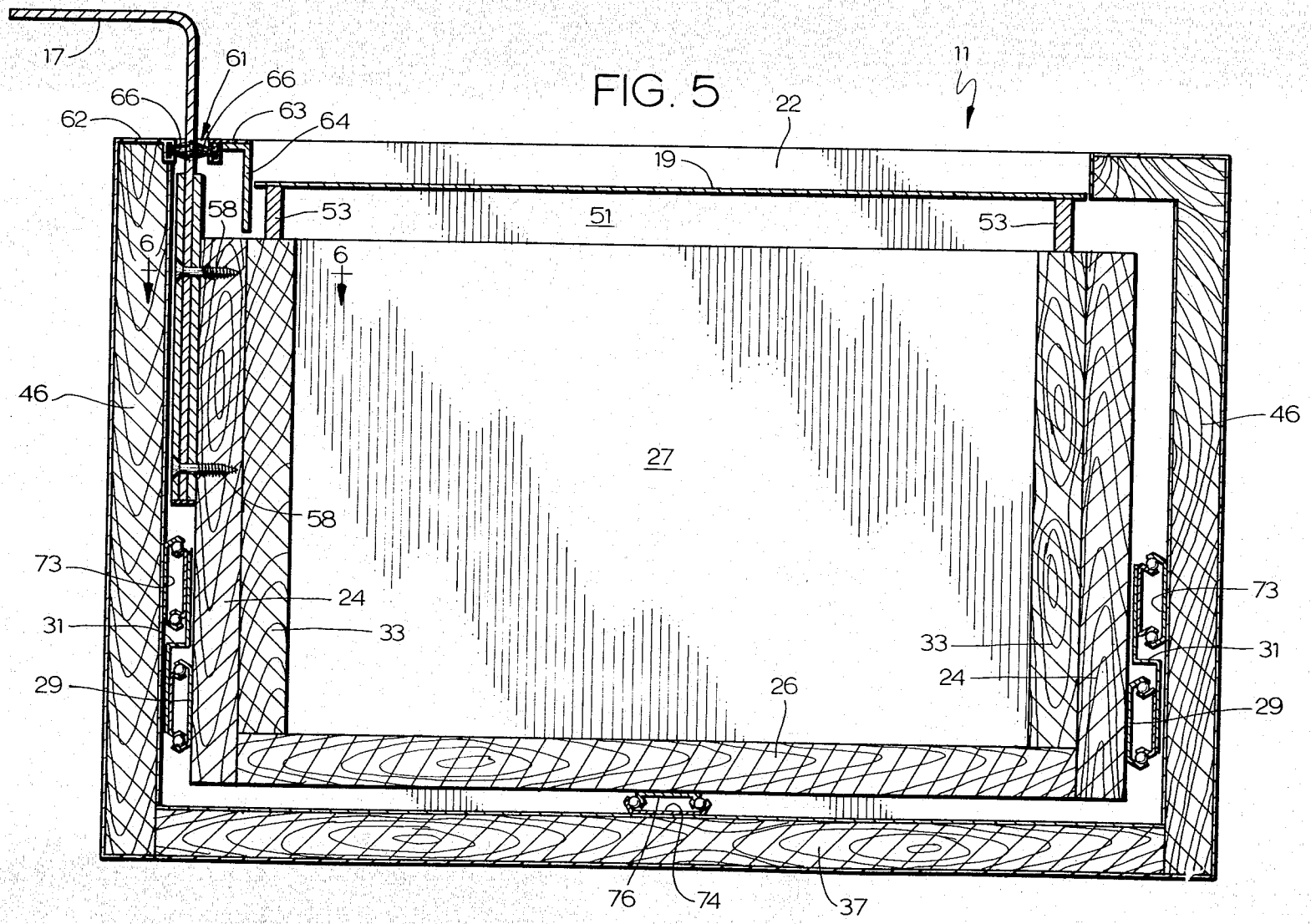
FIG. 5 is a cross section through the drawer taken at line 5—5 in FIG. 4 and viewed in the direction of the arrow.

As shown in FIG. 5, the drawer is supported by extension slides, with front slide portion 29 affixed to the drawer sidewall, the intermediate slide 31 rollingly supporting portion 29 and rolling on the outer slide portion 73 which is affixed to the inside face of the housing wall. Similarly, a ball bearing slide is provided at the bottom of the drawer and includes the portion 74 affixed to the bottom wall of the housing, and the member 76 rolling thereon and affixed to the drawer bottom.

The metal parts exposed to the exterior, such as the front door and the flange are preferably made of stainless steel. Certain of the drawer parts are preferably made of ultra high molecular weight (UHMW) plastic material. Examples are the floor, side and rear walls, center stop 32, cams 33 and cam follower rails 53.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A through-a-wall transaction assembly comprising:

a housing having outer and inner ends;

a drawer having an open top and having a front end adjacent the outer end of the housing, said drawer being movably mounted in said housing for movement between a first position wherein the drawer is in the housing and a second position wherein the front of the drawer is projected beyond the outer end of the housing;

a drawer cover pivotally mounted in position over the drawer and having an access-accommodating position exposing at least a portion of the top and interior of said drawer to an area behind the outer end of the housing when said drawer is in said first position, and said cover being supported in an access-exclusionary position when said drawer is in said second position;

first cam means on said drawer and operable to move said cover from said access-accommodating position to said access-exclusionary position as said drawer is moved from said first position to said second position; and said cam means including curved shoulders at the side walls of the drawer.

2. The assembly of claim 1 wherein:

said cover is pivotally mounted to said housing above the drawer, and said curved shoulders engage cam follower means on the underside of the cover.

3. The assembly of claim 2 wherein:

the pivotal mounting is at the rear marginal portion of the cover where said cover is hinged to the housing at a level above the drawer.

4. A through-a-wall transaction assembly comprising:

a housing having outer and inner ends;

a drawer having an open top and having a front end adjacent the outer end of the housing, said drawer being movably mounted in said housing for movement between a first position wherein the drawer is in the housing and a second position wherein the front of the drawer is projected beyond the outer end of the housing;

a drawer cover pivotally mounted in position over the drawer and having an access-accommodating position exposing at least a portion of the top and interior of said drawer to an area behind the outer end of the housing when said drawer is in said first position, and said cover being supported in an access-exclusionary position when said drawer is in said second position;

a front door on said housing, said front door being normally closed;

means on said drawer engageable with the front door to open said door as said drawer is moved from said first position to said second position; and means pivotally mounting said door to said housing such that said door opens outward but the maximum extension of said door from said housing is substantially less than the amount of projection of the front of the drawer from the outer end of the housing;

the pivotal mounting means including brackets near the outer end of the housing and secured to said door and having a pivot axis behind the outer end of the housing and below the top of the drawer.

5. The assembly of claim 4 wherein:

the drawer has a front end wall, and said walls higher than the front end wall, the door being as high as the side walls of the drawer.

6. The assembly of claim 5 wherein:

the cover has a rear marginal portion hinged to said housing;

said assembly further comprising:

first cam means on said drawer and operable to move said cover from said access-accommodating position to said access-exclusionary position as said drawer is moved from said first position to said second position;

said means to open said door being second cam means on said drawer.

7. The assembly of claim 6 wherein:

said first and second cam means are shaped to cause more rapid rotational movement of said cover about its hinge axis than the movement of said door about its pivot axis as said drawer is moved from said first position to said second position, to minimize opportunity from communication through said housing from the outer end of the housing to the area behind the outer end as said drawer is moved from the first position to the second position.

8. The assembly of claim 7 wherein:

said cam means include curved edges at the side walls of the drawer.

9. The assembly of claim 8 wherein:

the curved edges of the first cam means have a smaller average radius of curvature than the curved edges of the second cam means and engage follower means on the underside of the cover.

10. The assembly of claim 8 wherein:

the second cam means include the front edges of the side walls of said drawer.

11. The assembly of claim 10 wherein:

the rear marginal portion of the cover is hinged to the housing at a level about the drawer.

12. A through-a-wall transaction assembly comprising:

a housing having outer and inner ends;

a drawer having an open top and having a front end adjacent the outer end of the housing, said drawer being movably mounted in said housing for movement between a first position wherein the drawer is in the housing and a second position wherein the front of the drawer is projected beyond the outer end of the housing;

a drawer cover pivotally mounted in position over the drawer and having an access-accommodating position exposing at least a portion of the top and interior of said drawer to an area behind the outer end of the housing when said drawer is in said first position, and said cover being supported in an access-exclusionary position when said drawer is in said second position;

first cam means on said drawer and cover and operable to move said cover from said access-accommodating position to said access-exclusionary position as said drawer is moved from said first position to said second position;

a front door on said housing, said front door being normally closed when said drawer is in said first position; and means on said drawer engageable with the front door to open said door as said drawer is moved from said first position to said second position;

said means to open said door including second cam means on said drawer and door; and said first and second cam means being shaped to cause more rapid movement of said cover from said access-accommodating position to said access-exclusionary position, than the movement of said door from its closed position to its open position as said drawer is moved from said first position to said second position, to minimize opportunity for communication through said housing from the outer end of the housing to the area behind the outer end as said drawer is moved from its first position to its second position.

13. The assembly of claim 12 wherein:

said first and second cam means include curved cam surfaces on said drawer, said curved cam surfaces of said first cam means being of shorter radii than the said curved cam surfaces of said second cam means.

14. The assembly of claim 12 and further comprising:

a building wall having an opening therein, said area behind the outer end of the housing and to which a portion of the interior of the drawer is exposed when the drawer is in the first position, being inside the building;

the outer end of the housing being at the exterior of said wall.

15. The assembly of claim 14 wherein:

a counter is behind the wall inside the building;

said housing is secured to said counter.

16. The assembly of claim 15 and further comprising:

a window in said wall above the housing;

said door opening upward and outward away from said wall.

17. The assembly of claim 16 and further comprising:

pivotal mounting means connecting said door to said housing and positioned to permit said door to extend outward from said wall less than the amount of extension of said drawer from said wall when said drawer is in said second position, whereby said drawer is uncovered for access at the outside of said wall, while said cover is in said access-exclusionary position.

* * * * *

UNITED STATES PATENT AND TRADEMARK OFFICE

CERTIFICATE OF CORRECTION

PATENT NO. : 4,517,901

DATED : May 21, 1985

INVENTOR(S) : Larry G. Clark

It is certified that error appears in the above-identified patent and that said Letters Patent is hereby corrected as shown below:

In column 5, line 25, replace "said" with --side--.

In column 5, line 45, replace "from" with --for--.

In column 5, line 63, replace "about" with --above--.

Signed and Sealed this

*Seventeenth* Day of *September 1985*

[SEAL]

*Attest:*

DONALD J. QUIGG

*Attesting Officer*

*Commissioner of Patents and Trademarks—Designate*